US007747196B2

(12) United States Patent
Nobuoka et al.

(10) Patent No.: US 7,747,196 B2
(45) Date of Patent: Jun. 29, 2010

(54) IMAGE FORMING APPARATUS WITH AN OPEN-CLOSE COVER

(75) Inventors: Youichi Nobuoka, Saitama (JP); Kouichi Shimada, Saitama (JP); Kazuhiro Hirata, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 306 days.

(21) Appl. No.: 11/694,782

(22) Filed: Mar. 30, 2007

(65) Prior Publication Data

US 2008/0063430 A1 Mar. 13, 2008

(30) Foreign Application Priority Data

Sep. 8, 2006 (JP) ..... 2006-243752

(51) Int. Cl.
*G03G 21/00* (2006.01)
*G03G 15/00* (2006.01)
*G03G 21/16* (2006.01)

(52) U.S. Cl. ..... 399/124; 399/125

(58) Field of Classification Search ..... 399/107, 399/124, 125
See application file for complete search history.

(56) References Cited

U.S. PATENT DOCUMENTS 4,814,817 A * 3/1989 Nishijima et al. ..... 399/125
5,323,210 A * 6/1994 Inomata ..... 399/125 X
6,510,301 B2 * 1/2003 Tanaka ..... 399/125
6,973,279 B2 * 12/2005 Yokoi ..... 399/124
2005/0191086 A1 9/2005 Kawai et al.

FOREIGN PATENT DOCUMENTS

CN 1661499 A 8/2005
JP 8-18724 A 1/1996
JP 08-018724 B 2/1996
JP 2002-351282 A 12/2002

* cited by examiner

*Primary Examiner*—Sandra L Brase
(74) *Attorney, Agent, or Firm*—Sughrue Mion, PLLC

(57) ABSTRACT

An image forming apparatus includes: an image forming apparatus main body that includes an image forming unit and a sheet conveyance unit; a unit that is at least a part of the image forming unit or the sheet conveyance unit and is openably/closably provided with respect to the image forming apparatus main body; an open-close cover that is openably/closably provided with respect to the image forming apparatus main body; a connection unit that connects the unit to the open-close cover; a connection release unit that releases connection between the unit and the open-close cover by the connection unit; a pressing unit that presses the unit in a closing direction with respect to the image forming apparatus main body; and a prohibition unit that prohibits release of connection by the connection release unit.

16 Claims, 10 Drawing Sheets

IMAGE FORMING APPARATUS WITH AN OPEN-CLOSE COVER

CROSS-REFERENCE TO RELATED APPLICATIONS

This application is based on and claims priority under 35 USC 119 from Japanese Patent Application No. 2006-243752 filed Sep. 8, 2006.

BACKGROUND

1. Technical Field

The present invention relates to an image forming apparatus such as a copier, a facsimile machine or a printer.

2. Related Art

In a known technique regarding an image forming apparatus, the apparatus has an image forming apparatus main body including an image forming unit and a sheet conveyance unit, a unit which is at least a part of the image forming unit or the sheet conveyance unit and is openably/closably provided with respect to the image forming apparatus main body, and an open-close cover openably/closably provided with respect to the image forming apparatus main body.

SUMMARY

According to an aspect of the invention, there is provided an image forming apparatus including: an image forming apparatus main body that includes an image forming unit and a sheet conveyance unit; a unit that is at least a part of the image forming unit or the sheet conveyance unit and is openably/closably provided with respect to the image forming apparatus main body; an open-close cover that is openably/closably provided with respect to the image forming apparatus main body; a connection unit that connects the unit to the open-close cover; a connection release unit that releases connection between the unit and the open-close cover by the connection unit; a pressing unit that presses the unit in a closing direction with respect to the image forming apparatus main body; and a prohibition unit that prohibits release of connection by the connection release unit.

BRIEF DESCRIPTION OF THE DRAWINGS

Exemplary embodiments of the present invention will be described in detail based on the following figures, wherein.

DETAILED DESCRIPTION

Next, a first exemplary embodiment of the present invention will be described based on the drawings.

Figure 1:
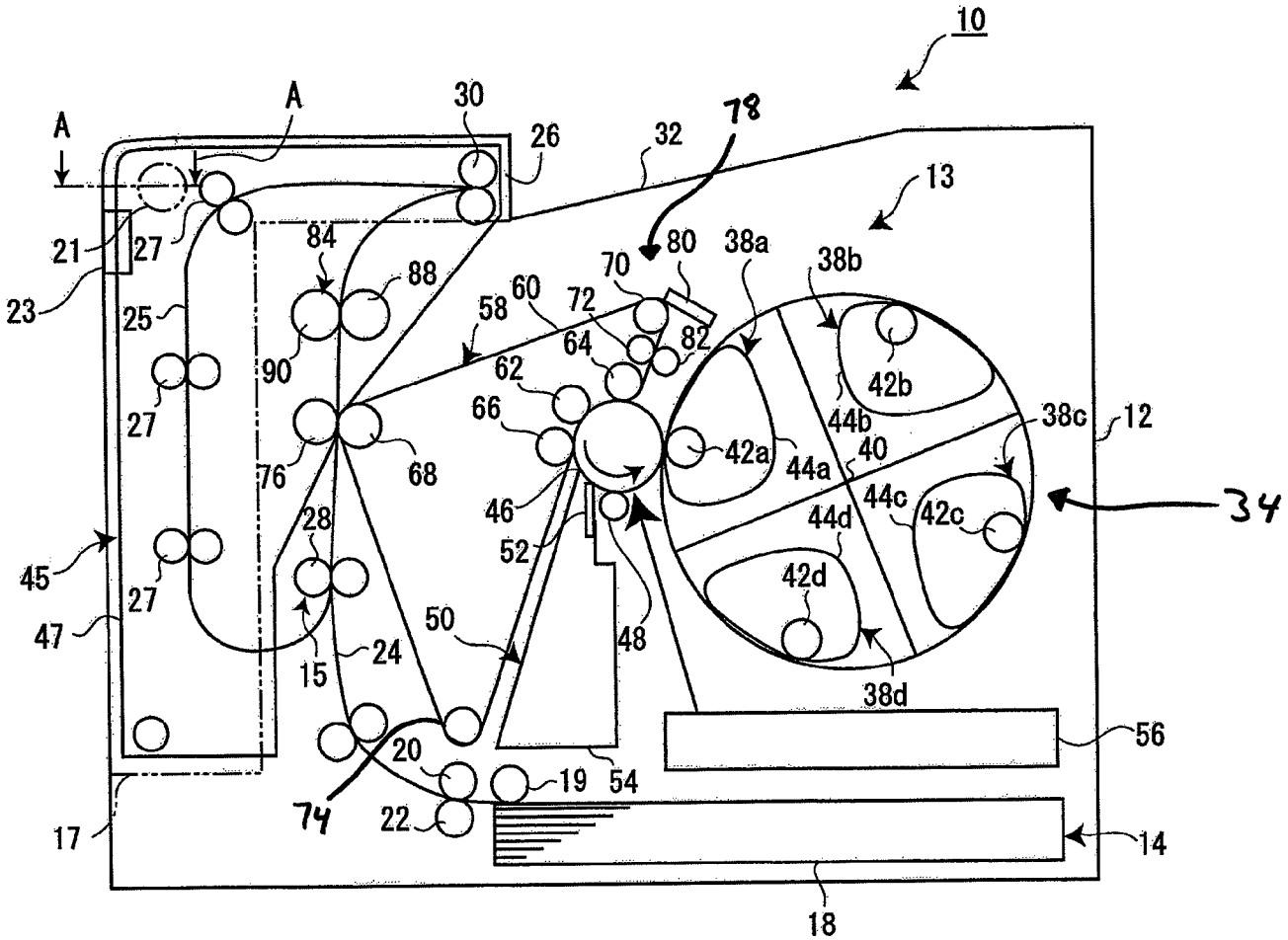
FIG. 1 is a cross-sectional view schematically showing the structure of an image forming apparatus according to a first exemplary embodiment of the present invention.

FIG. 1 shows an overview of an image forming apparatus 10 according to the first exemplary embodiment of the present invention. The image forming apparatus 10 has an image forming apparatus main body 12. The image forming apparatus main body 12 includes an image forming part 13 as an image forming unit and a sheet conveyance mechanism 15 as a sheet conveyance unit. Further, the image forming apparatus main body 12 is provided with an open-close cover 17 openable/closable with respect to the image forming apparatus main body 12.

The open-close cover 17 is provided with a first operation button 21 used as a first operation unit and a second operation button 23 used as a second operation unit. The details of the first operation button 21 and the second operation button 23 will be described later.

The sheet conveyance mechanism 15 has a sheet feed unit 14 of e.g. a single-stage cassette type. The sheet feed unit 14 has a sheet feed cassette 18 holding e.g. normal paper sheets.

A pickup roller 19 to pick up a sheet from the sheet feed cassette 18, a feed roller 20 to feed the sheet picked up with the pickup roller 19 to a main conveyance path 24 to be described later, and a retard roller 22 to feed the sheet supplied from the feed roller 22 one by one, are provided around the sheet feed cassette 18.

Further, the sheet conveyance mechanism 15 has the main conveyance path 24. The main conveyance path 24 is a sheet passage from the feed roller 20 to a discharge outlet 26. The main conveyance path 24 is provided on the front side of the image forming apparatus main body 12 (left side in FIG. 1), and formed approximately vertically from the sheet feed unit 14 to a fixing device 84 to be described later. A second transfer roller 76 and a second transfer backup roller 68 are provided on the main conveyance path 24 on the upstream side of the fixing device 84, and registration rollers 28 are provided on the upstream side of the second transfer roller 76 and the second transfer backup roller 68. Further, discharge rollers 30 are provided around the discharge outlet 26 of the main conveyance path 24.

In the sheet conveyance mechanism 15 having the above structure, the sheet picked up with the pickup roller 19 from the sheet feed cassette 18 of the sheet feed unit 14 and sent with the feed roller 20 is fed with the retard roller 22, and only the top sheet is guided to the main conveyance path 24. The sheet is temporarily stopped with the registration rollers 28, then a developing material image is transferred onto the sheet passing between the second transfer roller 76 and the second transfer backup roller 68 at predetermined timing. The transferred developing material image is fixed with the fixing device 84 to the sheet, and discharged with the discharge rollers 30 from the discharge outlet 26 to a sheet discharge part 32 provided in an upper part of the image forming apparatus main body 12.

Further, the sheet conveyance mechanism 15 has a reverse conveyance path 25. The reverse conveyance path 25 is a sheet passage from the discharge rollers 30 to the registration rollers 28. Reverse conveyance rollers 27 are provided along the reverse conveyance path 25 so as to reverse and convey a sheet, fed from the rear end side, by reverse rotation of the discharge rollers 30, to the registration rollers 28. The reverse conveyance path 25 is used when a sheet, already subjected to image formation on its one surface, is further subjected to image formation on the other surface.

The image forming part 13 has a rotary developing device 34. The rotary developing device 34 is provided in a position opposite to an intermediate transfer body 60 to be described later, with a photoreceptor 46 to be described later therebetween. The rotary developing device 34, which includes developing units 38*a* to 38*d* for forming yellow, magenta, cyan and black developing material images in a developing unit main body 36, rotates about a rotary developing device center 40. The developing units 38*a* to 38*d* have developing rollers 42*a* to 42*d* respectively pressed with an elastic member (not shown) such as a coil spring in a normal line direction of the developing unit main body 36. Further, the developing units 38*a* to 38*d* have developing material cartridges 44*a* to 44*d* filled with yellow, magenta, cyan and black developing material such as toner. The developing material cartridges 44*a* to 44*d* are removably attached in the image forming apparatus main body 12.

The photoreceptor 46 having a drum shape used as an image holder is provided in contact with the rotary developing device 34. In the developing rollers 42*a* to 42*d*, not in contact with the photoreceptor 46, a part of the outer periphery of each developing roller is projected from the outer periphery of the developing unit main body 36 in the radial direction by e.g. 2 mm. Further, a tracking roller (not shown) having a diameter slightly larger than that of the developing roller 42*a* to 42*d* is provided at both ends of the developing rollers 42*a* to 42*d*, coaxially rotatably with the developing rollers 42*a* to 42*d*. Accordingly, the tracking rollers of the developing rollers 42*a* to 42*d* are in contact with flanges (not shown) provided at both ends of the photoreceptor 46, predetermined gaps are formed between the developing rollers 42*a* to 42*d* and the photoreceptor 46, and latent images are formed with respective color developing material on the photoreceptor 46.

Further, the image forming part 13 has a charging device 48, a photoreceptor cleaner 50, an exposure device 56, an intermediate transfer device 58 and the fixing device 84.

The charging device 48, used as a charging unit to uniformly charge the photoreceptor 46 with a charging roller, is provided under the photoreceptor 46. The photoreceptor cleaner 50 is provided on the upstream side of the charging device 48 in a rotational direction of the photoreceptor 46. The photoreceptor cleaner 50 has a cleaning blade 52 to scraping developing material remaining on the photoreceptor 46 after e.g. first transfer, and a developing material collection bottle 54 to collect the developing material scraped with the cleaning blade 52. The exposure device 56 is provided below the rotary developing device 34. The exposure device 56 is used as a latent image forming unit to form a latent image with a light beam such as a laser beam on the photoreceptor 46 charged with the charging device 48.

The intermediate transfer device 58 is provided in a front direction (leftward direction in FIG. 1) from the rotary developing device 34. The intermediate transfer device 58 first-transfers a developing material image visualized with the rotary developing device 34 in a first transfer position, and conveys the image to a second transfer position to be described later. The intermediate transfer device 58 has a belt-shaped intermediate transfer body 60 used as an intermediate transfer medium, a first transfer roller 62, a wrap in roller 64, a wrap out roller 66, the second transfer backup roller 68, a scraper backup roller 70, a brush backup roller 72 and a support roller 74.

The intermediate transfer body 60 forms a first transfer portion in wrap-contact with the photoreceptor 46 between the wrap in roller 64 and the wrap out roller 66 provided on the rear side of the intermediate transfer body 60. The intermediate transfer body 60 is wound around the photoreceptor 46 only within a predetermined range, and is rotated in accordance with the photoreceptor 46. The yellow, magenta, cyan and black developing material images in, e.g., this order, on the photoreceptor 46, are first-transferred with the first transfer roller 62 onto the intermediate transfer body 60, and the first-transferred developing material images overlapped on the intermediate transfer body 60 are conveyed toward the second transfer roller 76 to be described later.

A projection is formed with the second transfer backup roller 68 on the front side (left side in FIG. 1) of the intermediate transfer body 60. The projection, as a second transfer portion, approaches the main conveyance path 24.

The scraper backup roller 70 assists a scraper 80 in scraping of developing material remaining on the intermediate transfer body 60 after second transfer. The brush backup roller 72 assists a brush roller 82 to be described later in sweeping developing material remaining on the intermediate transfer body 60 after the second transfer.

The second transfer roller 76 is provided to be opposite to the second transfer backup roller 68 of the intermediate transfer device 58 with the main conveyance path 24 therebetween. The second transfer position is provided between the second transfer roller 76 and the second transfer backup roller 68. The second transfer roller 76 second-transfers the developing material image, first-transferred on the intermediate transfer body 60, onto a sheet, by assistance of the second transfer backup roller 68.

Further, the intermediate transfer device 58 has an intermediate transfer body cleaner 78. The intermediate transfer body cleaner 78, provided at an upper end of the intermediate transfer body 60, is used as an intermediate transfer medium cleaning unit to clean the intermediate transfer body 60. The intermediate transfer body cleaner 78 has the scraper 80 to scrape developing material remaining on the intermediate transfer body 60 after e.g. second transfer, the brush roller 82 to further sweep the developing material remaining on the intermediate transfer body 60 after the cleaning by the scraper 80, and a developing material collection bottle (not shown) to collect the developing material scraped with the scraper 80 and the brush roller 82.

The fixing device 84 is provided downstream of the second transfer position in a sheet conveyance direction. The fixing device 84 has a heating roller 88 and a pressure roller 90. The fixing device 84 fixes the developing material image, second-transferred on the sheet, to the sheet using the second transfer roller 76 and the second transfer backup roller 68, with heat and pressure, and conveys the sheet toward the discharge rollers 30.

The image forming part 13, the fixing device 84 as a part of the sheet conveyance mechanism 15, the reverse conveyance rollers 27, the discharge rollers 30 and the second transfer roller 76, as described above, are integrated as a unit 45. The unit 45 has a unit main body 47, and the fixing device 84, the reverse conveyance rollers 27, the discharge rollers 30 and the second transfer roller 76 are attached to the unit main body 47.

In the image forming apparatus 10 having the above arrangement, the photoreceptor 46 is uniformly charged with the charging device 48, and a light beam is emitted from an exposure device 56 based on an image signal to the charged photoreceptor 46. The light beam from the exposure device 56 exposes the surface of the photoreceptor 46, and forms a latent image on the surface of the photoreceptor 46. The latent image on the photoreceptor 46 formed with the exposure device 56 is developed with the rotary developing device 34 using yellow, magenta, cyan and black developing material, and first-transferred onto the intermediate transfer body 60 such that the respective color developing material images are overlaid there. After the first transfer, developing material remaining on the photoreceptor 46 is scraped with the photoreceptor cleaner 50 and collected.

On the other hand, the sheet placed in the sheet feed cassette 18 is picked up with the pickup roller 19, sent with the feed roller 20, and fed with the retard roller 22, thereby guided to the main conveyance path 24. Then the sheet is temporarily stopped with registration rollers 28, and guided between the second transfer roller 76 and the second transfer backup roller 68 at predetermined timing. When the sheet is guided between the second transfer roller 76 and the second transfer backup roller 68, the developing material image first-transferred on the intermediate transfer body 60 is second-transferred with the second transfer roller 76 and the second transfer backup roller 68 onto the sheet. After the second transfer, developing material remaining on the intermediate transfer body 60 is scraped with the intermediate transfer body cleaner 78 and collected.

The sheet holding the transferred developing material image is guided to the fixing device 84. The fixing device 84 fixes the developing material image using the heating roller 88 and the pressure roller 90 onto the sheet with heat and pressure, and discharges the sheet, to which the developing material image has been fixed, via the discharge rollers 30, to the sheet discharge part 32. When image formation is further performed on the opposite surface (rear surface) of the sheet surface where the image formation has been made, the discharge rollers 30 are reverse-rotated, to feed the sheet from the rear end side to the reverse conveyance rollers 27. Then the reverse conveyance rollers 27 reverse and refeed the sheet to the registration rollers 76, and image formation is made on the rear surface of the sheet.

Figure 2:
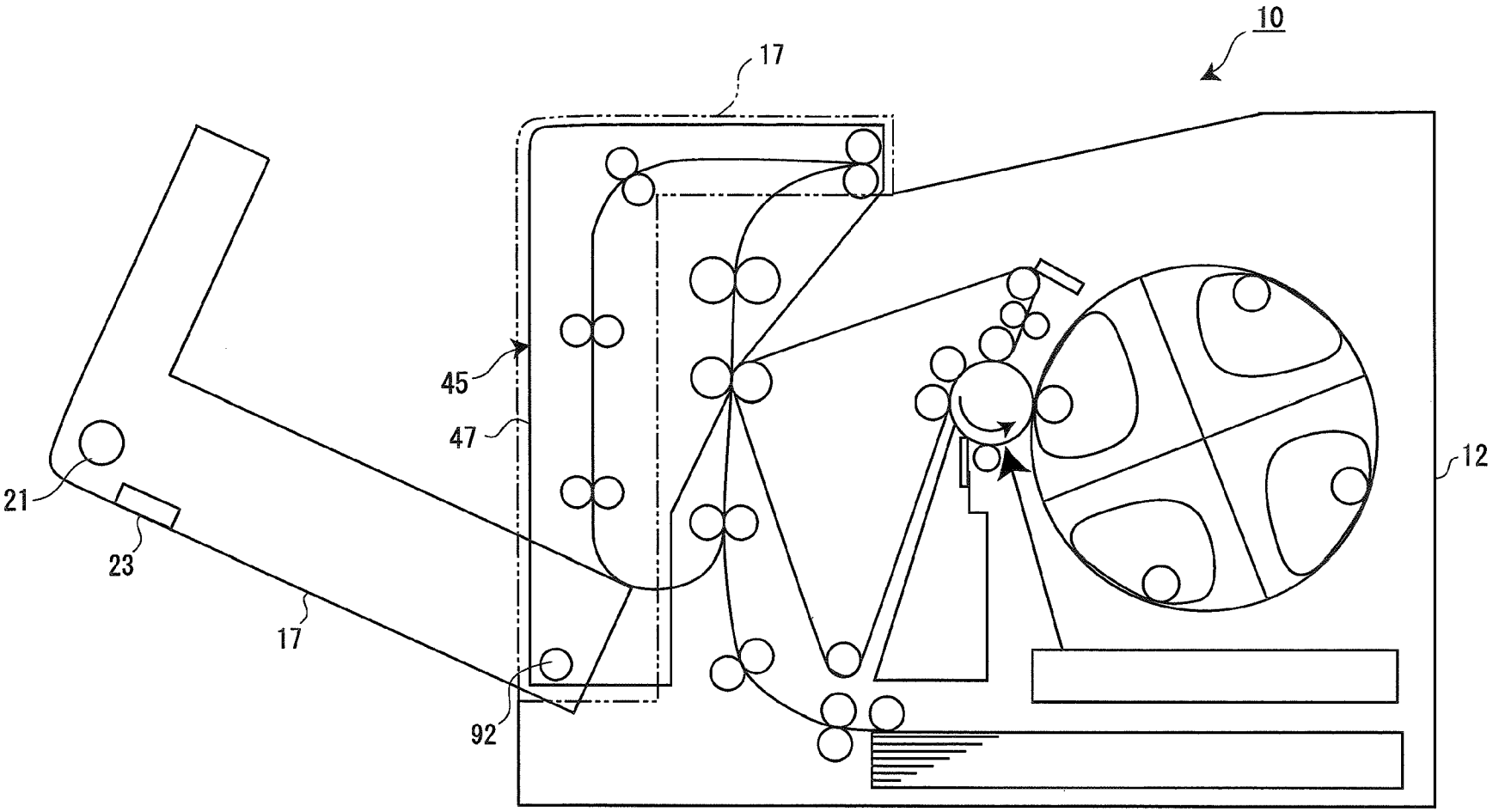
FIG. 2 is a cross-sectional view showing an open-close cover, in an opened status, used in the image forming apparatus according to the first exemplary embodiment of the present invention.

FIG. 2 shows the open-close cover 17 in an opened status with respect to the image forming apparatus main body 12. The open-close cover 17 is attached to the image forming apparatus main body 12 with a hinge 92, and is closed with respect to the image forming apparatus main body 12 as shown in FIG. 1 and is opened with respect to the image forming apparatus main body 12 as shown in FIG. 2.

Figure 3:
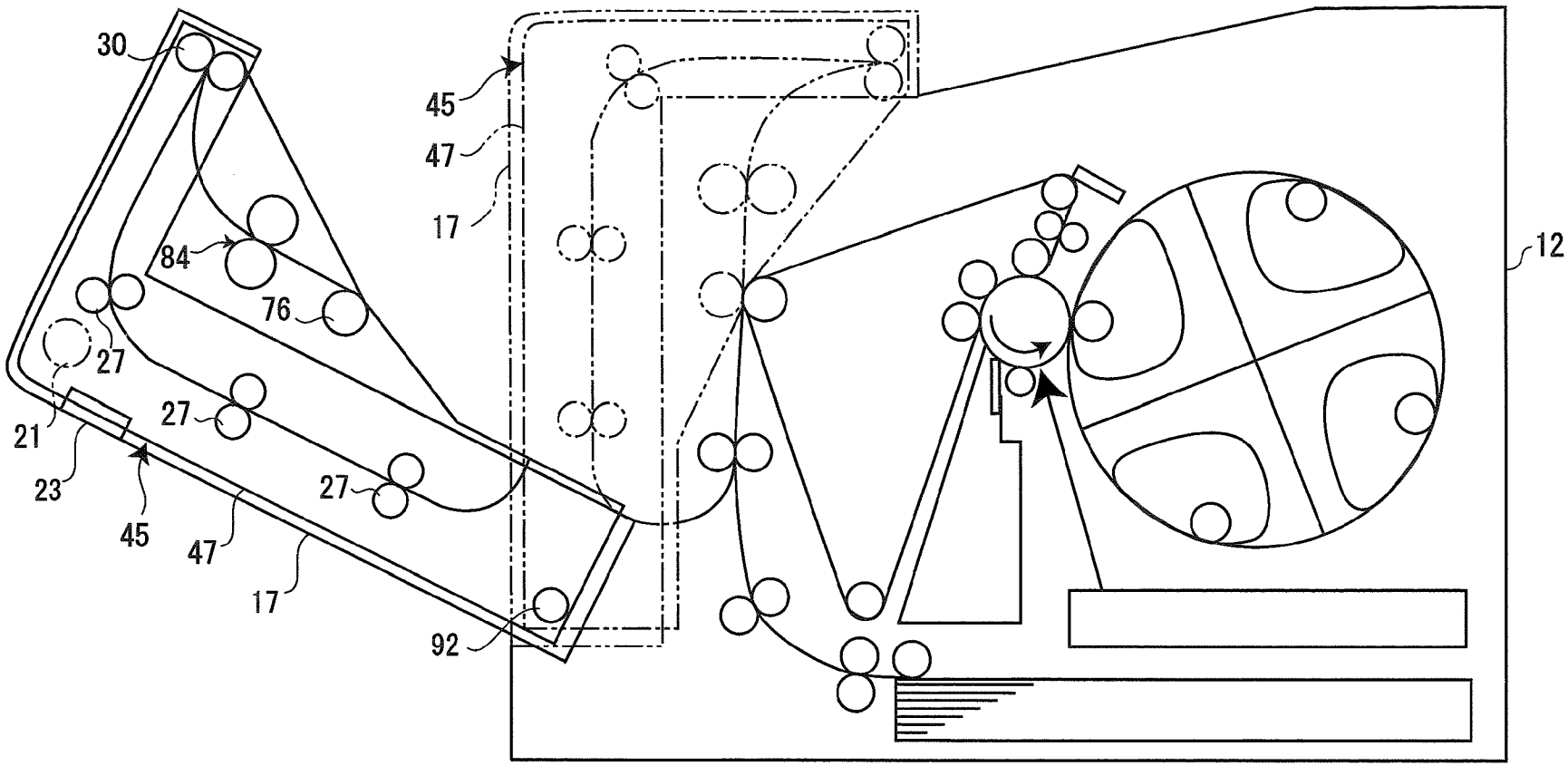
FIG. 3 is a cross-sectional view showing the open-close cover and a unit, in an opened status, used in the image forming apparatus according to the first exemplary embodiment of the present invention.

FIG. 3 shows the open-close cover 17 and the unit 45 in an opened status with respect to the image forming apparatus main body 12. A unit main body 47 of the unit 45 is attached to the image forming apparatus main body 12 with a hinge 92, and is closed with respect to the image forming apparatus main body 12 as shown in FIGS. 1 and 2 and is closed with respect to the image forming apparatus main body 12 as shown in FIG. 3.

The unit 45 is attached with the hinge 92, the same-as that in the open-close cover 17, to the image forming apparatus main body 12. When the unit 45 is opened, it is opened together with the open-close cover 17, with respect to the image forming apparatus main body 12. On the other hand, the open-close cover 17 can be opened together with the unit 45 with respect to the image forming apparatus 12, and can also be opened, while the unit 45 is closed, with respect to the image forming apparatus main body 12, as shown in FIG. 2.

When the open-close cover 17 is opened while the unit 45 is closed, an operator depresses the first operation button 21. On the other hand, when the open-close cover 17 is opened together with the unit 45, the operator depresses the second operation button 23. The details of the first operation button 21 and the second operation button 23 will be described later.

The unit 45 is openable/closable with respect to the image forming apparatus main body 12. Further, as described above, the unit 45 has the fixing device 84, the reverse conveyance rollers 27, the discharge rollers 30 and the second transfer roller 76, and has a predetermined weight. Accordingly, when the unit 45 is opened to the status as shown in FIG. 3 from the closed status as shown in FIGS. 1 and 2, there is a probability that the gravity acts on the unit 45 to accelerate the moving speed too much or an excessive force is applied to the hinge 92 thereby the hinge 92 is broken. In the present exemplary embodiment, a pressing mechanism as a pressing unit to press the unit 45 in a closing direction with respect to the image forming apparatus main body 12 is provided.

Figure 4:
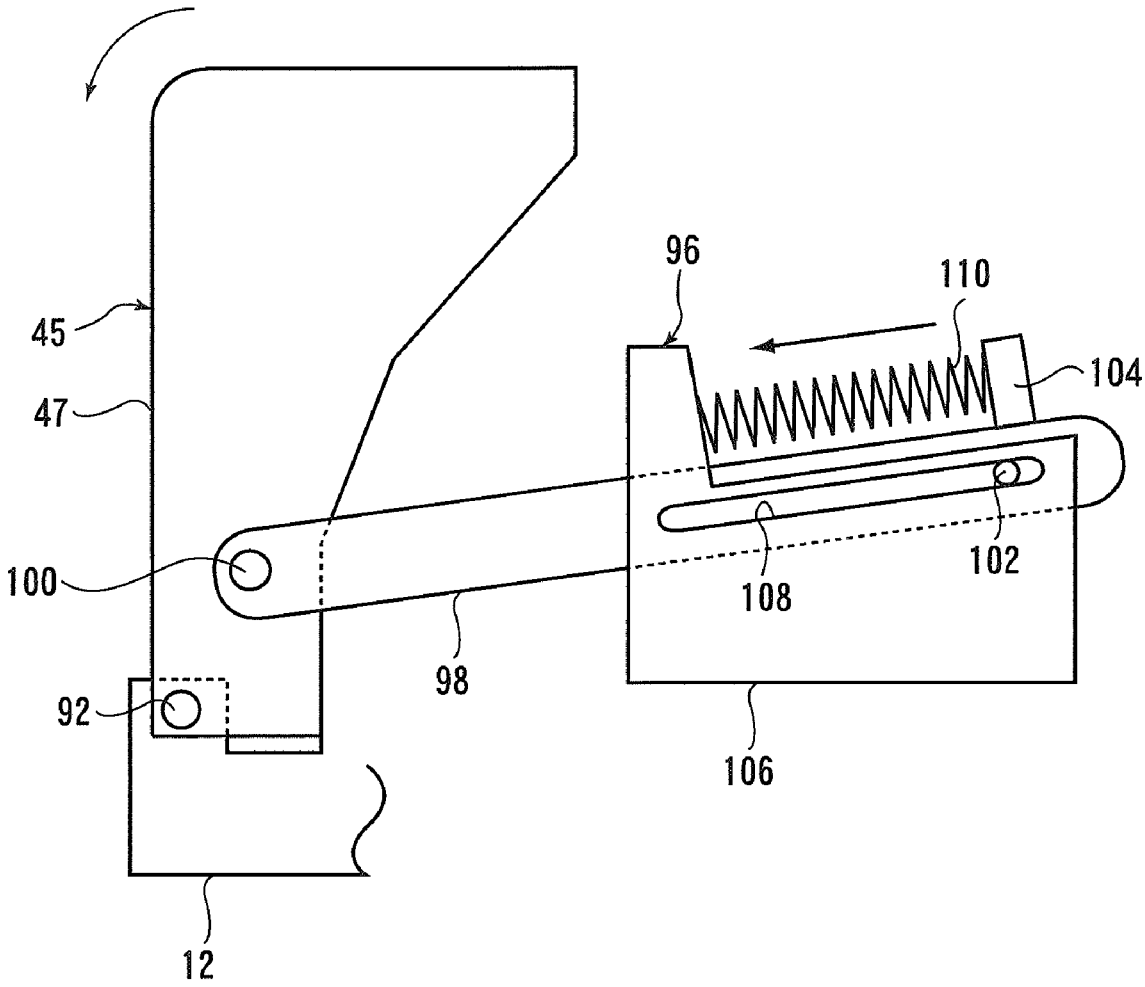
FIG. 4 is a cross-sectional view showing the structure of a pressing mechanism of the image forming apparatus according to the first exemplary embodiment of the present invention.

FIG. 4 shows the structure of a pressing mechanism 96. The pressing mechanism 96 has an arm member 98, and one end side of the arm member 98 is attached to the unit main body 47 rotatably about a shaft 100. On the other end side of the arm member 98, a sliding projection 102 is formed in a direction outward from the image forming apparatus main body 12 and a spring bearing 104 is formed to be projected upward.

Further, the pressing mechanism 96 has a support member 106 fixed to the image forming apparatus main body 12 side. The support member 106 to slidably support the arm member 98 has a guide hole 108, into which the sliding projection 102 is inserted. That is, the arm member 98 is slidably supported with the support member 106 such that the sliding projection 102 is slided along the guide hole 108. Further, the pressing mechanism 96, having a spring 110, is also used as a pressing member. One end of the spring 110 is fixed to the spring bearing 104, and the other end of the spring 110 is fixed to the support member 106 in a position not preventing the movement of the arm member 98.

In the pressing mechanism 96, when the unit 45 is opened as indicated with an arrow in FIG. 4, the end of the pressing mechanism 96 where the shaft 100 of the arm member 98 is provided is drawn frontward (leftward in FIG. 4) in accordance with the movement of the unit main body 47. The arm member 98, being drawn, is moved to the front side while it is guided with the guide hole 108, and applies a force in a direction to contract the spring 110, to contract the spring 110. Accordingly, the arm member 98 and the unit main body 47 connected with the arm member 98 receive a force, as a counteraction of the above force, in a direction to close the unit main body 47 about the hinge 92.

As described above, in the present exemplary embodiment, the pressing mechanism 96 prevents the excessive acceleration of the moving speed of the unit 45 upon opening and application of excessive force to the hinge 92. In a status where the unit 45 is completely opened (see FIG. 3), a balance is struck between the force in a direction to close the unit 45 with the spring 110 and the gravity applied to the unit 45. In the above description, the pressing mechanism 96 is provided on the right side (front side in FIG. 4) of the image forming apparatus 10, however, the pressing mechanism 96 is also provided on the left side of the image forming apparatus 10. That is, the image forming apparatus 10 has two pressing mechanisms 96 on the right side and the left side.

The unit 45 is openable/closable with respect to the image forming apparatus main body 12 as described above. When image formation is performed, i.e., the unit 45 is closed with respect to the image forming apparatus main body 12, there is a probability of e.g. degradation of the quality of formed image due to bad positioning of the unit 45 to the image forming apparatus main body 12. Accordingly, in the present exemplary embodiment, a fixing mechanism to fix the unit 45 as a fixing unit to the image forming apparatus main body 12 is provided.

Figure 5A:
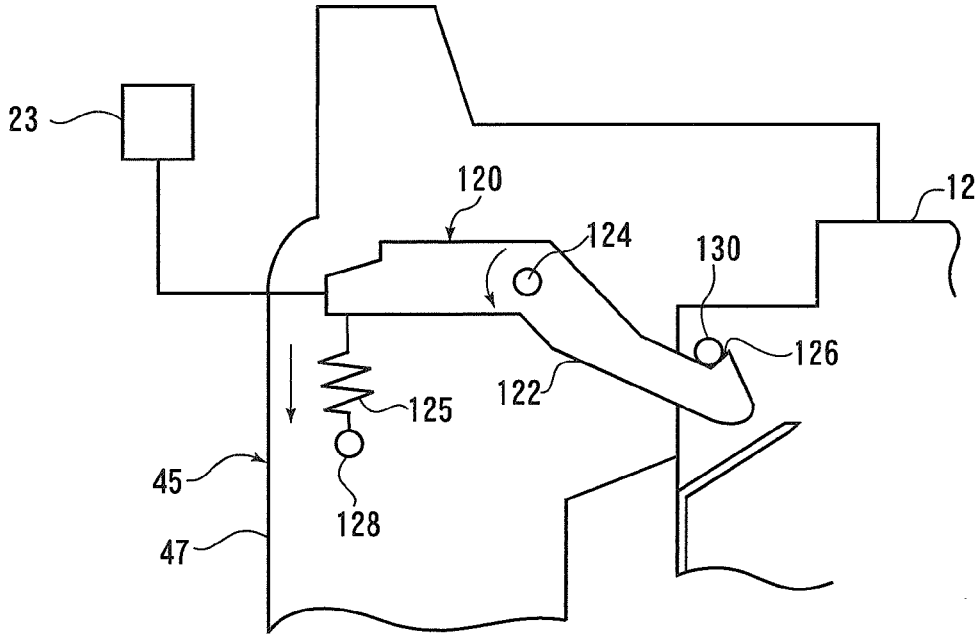
FIG. 5A is an explanatory view showing a fixing mechanism of the image forming apparatus according to the first exemplary embodiment of the present invention when a frame is fixed to the image forming apparatus.
Figure 5B:
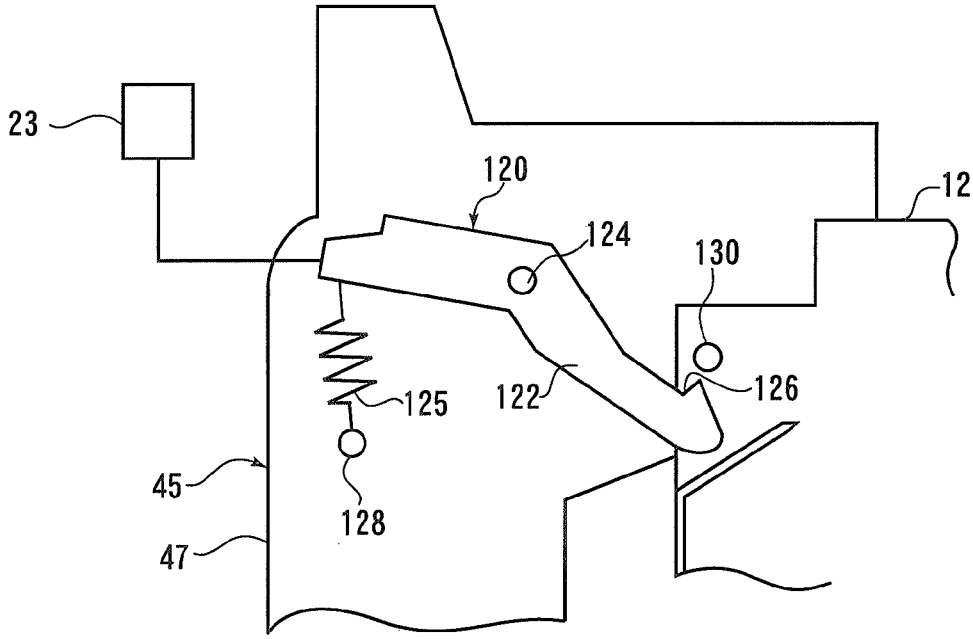
FIG. 5B is an explanatory view showing the fixing mechanism of the image forming apparatus according to the first exemplary embodiment of the present invention when fixing of the frame to the image forming apparatus is released.

FIGS. 5A and 5B show a fixing mechanism 120. The fixing mechanism 120 has an arm member 122 which is attached to the unit main body 47 rotatably about a shaft 124. One end of a spring 125 of an elastic material, used as a pressing member, is connected to one end of the arm member 122. The other end of the spring 125 is connected to the unit main body 47 using a projection 128 formed on the unit main body 47. The other end of the arm member 122 is provided with an engagement member 126 which is engaged with a projection 130 provided as an engaged member on the image forming apparatus main body 12 side. Accordingly, as shown in FIG. 5A, the arm member 122 is pressed with the spring 125 in a counterclockwise rotational direction. As the engagement member 126 is engaged with the projection 130, the unit 45 is positioned with respect to the image forming apparatus main body 12.

The above-described second operation button 23 is connected in e.g. a mechanical manner to the arm member 122. When the operator depresses the second operation button 23, the arm member 122 is rotated in a clockwise direction into a status as shown in FIG. 5B against the pressing with the spring 125. When the arm member 122 is rotated in the clockwise direction, the engagement member 126 is moved away from the projection 130, and the unit 45 can be opened with respect to the image forming apparatus main body 12.

In the image forming apparatus 10, the open-close cover 17 and the unit 45, integrated with each other, are opened with respect to the image forming apparatus main body 12 (see FIG. 3) as described above. The image forming apparatus 10 has a connection mechanism as a connection unit, used upon opening of the open-close cover 17 and the unit 45 integrated with each other and used for connection between the open-close cover 17 and the unit 45. Further, in the image forming apparatus 10, only the open-close cover 17 can be opened while the unit 45 is closed. The image forming apparatus 10 has a connection release mechanism as a connection release unit used upon opening of only the open-close cover 17 and used for release of connection between the open-close cover 17 and the unit 45 with the connection mechanism.

Figure 6A:
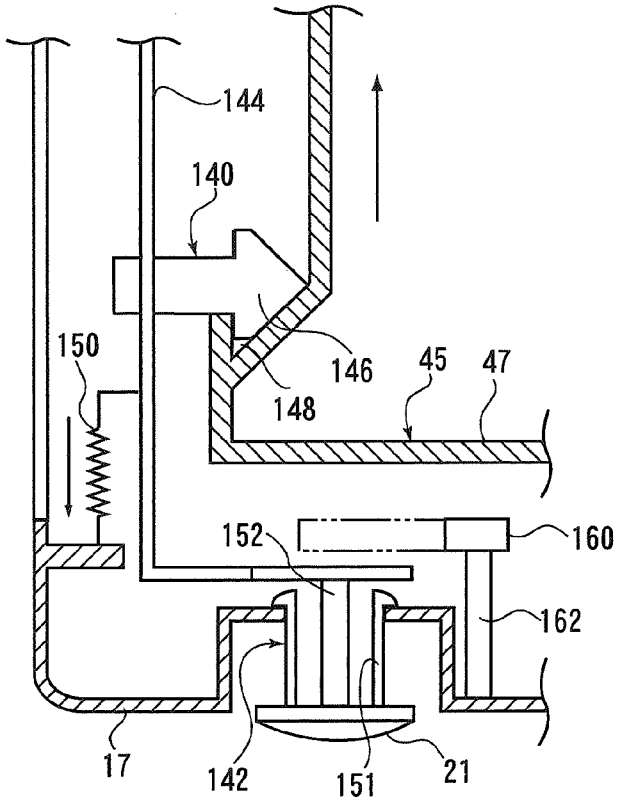
FIG. 6A is a cross-sectional view cut along an A-A line in FIG. 1 showing a connection mechanism and a connection release mechanism of the image forming apparatus according to the first exemplary embodiment of the present invention when the open-close cover and the frame are connected.
Figure 6B:
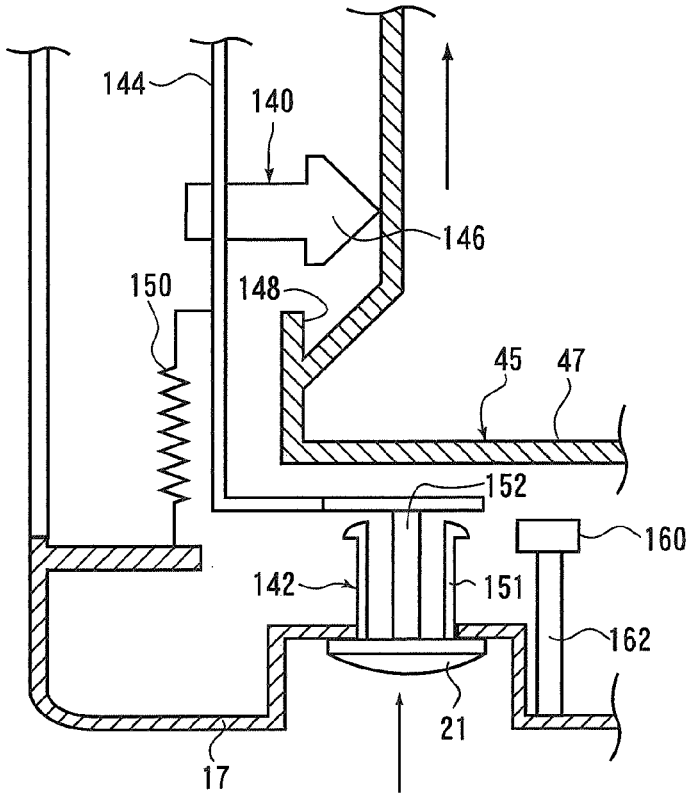
FIG. 6B is a cross-sectional view cut along the A-A line in FIG. 1 showing the connection mechanism and the connection release mechanism of the image forming apparatus according to the first exemplary embodiment of the present invention when connection between the open-close cover and the frame is released.

FIGS. 6A and 6B show a connection mechanism 140 and a connection release mechanism 142. The connection mechanism 140 has a moving member 144. The moving member 144 is supported with a support mechanism (not shown) movably with respect to the open-close cover 17 between a position shown in FIG. 6A and a position shown in FIG. 6B. The moving member 144 is provided with an engagement member 146. The engagement member 146 may be formed on the moving member 144 by forming a projection from the moving member 144 itself, or by attaching another member to the moving member 144. In the present exemplary embodiment, the engagement member 146 is provided by attaching another member to the moving member 144.

Further, the connection mechanism 140 has an engaged member 148, which is engaged with the engagement member 146, provided on the unit main body 47. The engaged member 148 may be formed on the unit main body 47 by forming a projection from the unit main body itself, or by attaching another member to the unit main body 47. In the present exemplary embodiment, the engaged member 148 is formed in the unit 45 by forming a projection from the unit main body 47.

The moving member 144, which is used as a pressing member, is connected to one end of a spring 150 of elastic material. The other end of the spring 150 is connected to the open-close cover 17 in a position right side (lower side in FIGS. 6A and 6B) from the one end of the spring 150 connected to the moving member 144 such that the spring 150 is expanded. Accordingly, the moving member 144 is pressed to the right side with the spring 150, and the engagement member 146 and the engaged member 148 are engaged with each other as shown in FIG. 6A. As the open-close cover 17 and the unit 45 are connected to each other using the connection mechanism 140, when the operator opens the open-close cover 17, the unit 45, pulled with the open-close cover 17, is also opened. Note that when the open-close cover 17 and the unit 45 are opened with respect to the image forming apparatus main body 12, it is necessary for the operator to manipulate the second operation button 23 (see FIG. 1), to release the fixing of the unit 45 to the image forming apparatus main body 12 by the fixing mechanism 120.

The connection release mechanism 142, which is also used as a moving mechanism to move the moving member 144, has a slide member 151 and a connection member 152 provided on the image forming apparatus main body 12 side of the first operation button 21. The slide member 151 is slidably supported with the open-close cover 17 in a status where the slide member is inserted into an opening on the left side surface of the open-close cover 17, and is moved between a position shown in FIG. 6A and a position shown in FIG. 6B. One side of the connection member 152, opposite to the side of the first operation button 21, is in contact with the moving member 144. Accordingly, the connection member 152, the first operation button 21 and the slide member 151, integrated with the moving member 144, are moved between a position shown in FIG. 6A and a position shown in FIG. 6B.

When only the open-close cover 17 is opened with respect to the image forming apparatus main body 12 while the unit 45 is closed (FIG. 2), the operator opens the open-close cover 17 while depressing the first operation button 21. When the first operation button 21 is depressed, as shown in FIG. 6A, the first operation button 21, the connection member 152, the moving member 144 and the engagement member 146, integrated with each other, are moved to the left side against the pressing with the spring 150. Then, as the engagement member 146 is moved to the left side, the engagement between the engagement member 146 and the engaged member 148 is released, and the connection between the open-close cover 17 and the unit 45 is released. Then, as the connection between the open-close cover 17 and the unit 45 is released, only the open-close cover 17 can be opened.

A pendulum member 160, which is used as an interference member, is provided in the moving member 144 around a position connected to the connection member 152. The pendulum member 160 is rotatably supported with a support shaft 162. The details of the pendulum member 160 will be described later.

In the image forming apparatus 10, as described above, the unit 45 is pressed with the pressing mechanism 96 in a direction to be closed with respect to the image forming apparatus main body 12 (see FIG. 4). The force applied from the pressing mechanism 96 to the unit 45 is balanced with the gravity acting on the unit 45 when the unit 45 is completely opened. Then, as described above, when the operator manipulates the first operation button 21, the connection between the open-close cover 17 and the unit 45 is released with the connection release mechanism 142. Accordingly, there is a probability that while the open-close cover 17 and the unit 45 integrated with each other are being opened/closed, if the connection release mechanism 142 is operated to separate the open-close cover 17 from the unit 45, the unit 45 in the middle of opening/closing receives a force from the pressing mechanism 96 and rapidly moved in a closing direction. In this case, trouble may occur in the opening/closing of the open-close cover 17 and the unit 45. In the present exemplary embodiment, a prohibition mechanism as a prohibition unit to prohibit release of connection between the open-close cover 17 and the unit 45 with the connection release mechanism 142 is provided. As the release of connection with the connection release mechanism 142 is prohibited in the middle of opening/closing of the open-close cover 17 and the unit 45 when integrated with each other, the operability is improved.

Figure 7:
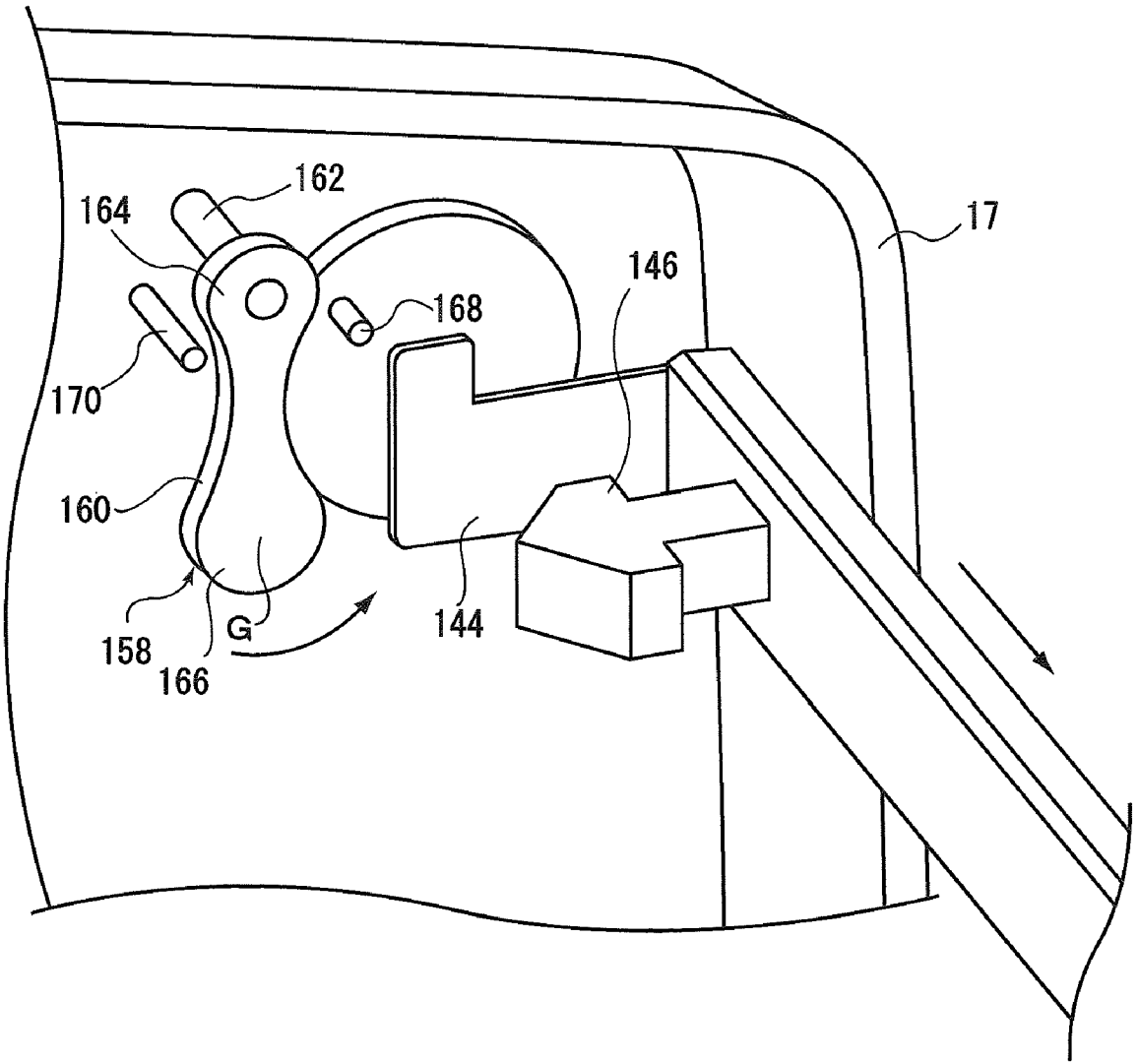
FIG. 7 is a perspective view showing a prohibition mechanism of the image forming apparatus according to the first exemplary embodiment of the present invention viewed from the inside of the image forming apparatus main body.

FIG. 7 shows a prohibition mechanism 158. The prohibition mechanism 158 has the pendulum member 160 used as an interference member. The pendulum member 160 has a support member 164 rotatably supported with the support shaft 162, projected from a surface of the open-close cover 17 facing the inside the image forming apparatus main body 12, and a gravity center member 166, integrated with the support member 164, as the center of gravity of the pendulum member 160. Even when the open-close cover 17 is opened/closed and the direction of the open-close cover 17 is changed, the pendulum member 160 rotates about the support shaft 162 such that the gravity center member 166 is positioned on the lower side of the support shaft 162 in the gravity direction. Further, limitation members 168 and 170 to limit the angle of rotation of the pendulum member 160 are provided around the pendulum member 160. The limitation members 168 and 170 are respectively projected from an inner surface of the open/close cover 17.

Figure 8:
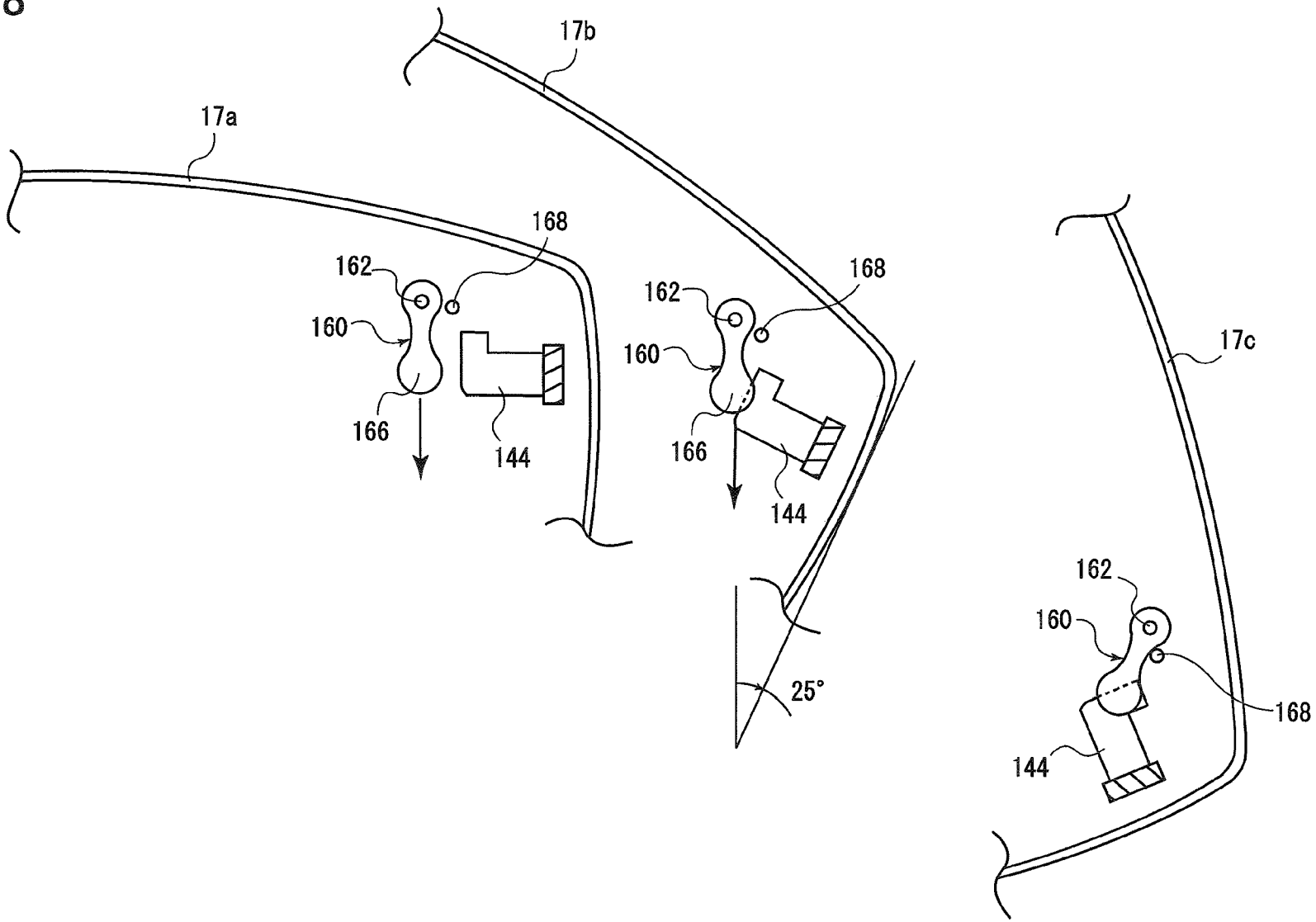
FIG. 8 is an explanatory view showing the fixing mechanism of the image forming apparatus according to a second exemplary embodiment of the present invention when the frame is fixed to the image forming apparatus main body and when the fixing of the frame to the image forming apparatus main body is released.

FIG. 8 shows the positional relationship between the pendulum member 160 and the moving member 144 corresponding to the open/closed status of the open-close cover 17. When the open-close cover 17 is closed (17*a* in FIG. 8), the pendulum member 160 is provided in a permission position to permit the movement of the moving member 144 to the left side (front side in FIG. 8). Accordingly, the moving member 144 is moved to the left side by depression of the first operation button 21 (see FIGS. 6A and 6B), and by the movement of the moving member 144, the connection between the open-close cover 71 and the unit 45 is released.

When the open-close cover 17 is gradually opened from a closed status, to a status where it is opened at 25° (17*b* in FIG. 8), the pendulum member 160 is provided in a position to interfere with a moving locus of the moving member 144 when it is moved to the left side (hereinbelow, interference position). That is, as the open-close cover 17 is opened, the pendulum member 160 is rotated so as to keep the status where the gravity center member 166 is positioned in the lower side of the support shaft 162 in the gravity direction, to a position to prevent the movement of the moving member 144. Then, from the 25° opened status to complete open status of the open-close cover 17 (17*c* in FIG. 8), the pendulum member 160 stays in the interference position. For example, when the open-close cover 17 is completely opened, although there is a probability that the rotational angle of the pendulum member 160 is too wide and the pendulum 160 passes the interference position, the limitation member 168 limits the rotational angle of the pendulum member 160, and the pendulum member 160 stays in the interference position.

In this manner, when the unit 45 is opened at 25° or wider angle, the pendulum member 160 is provided in the interference position and the moving member 144 cannot be moved. Even if the operator depresses the first operation button 21, the connection between the open-close cover 17 and the unit 45 with the connection mechanism 140 is not released. Note that when the open-close cover 17 and the unit 45 are opened at an angle less than 25°, as the force applied from the spring 110 (see FIG. 4) to the unit 45 is small, the speed of movement of the open-close cover 17 with the pressing mechanism 96 is within an allowable range from the point of operability.

Figure 9A:
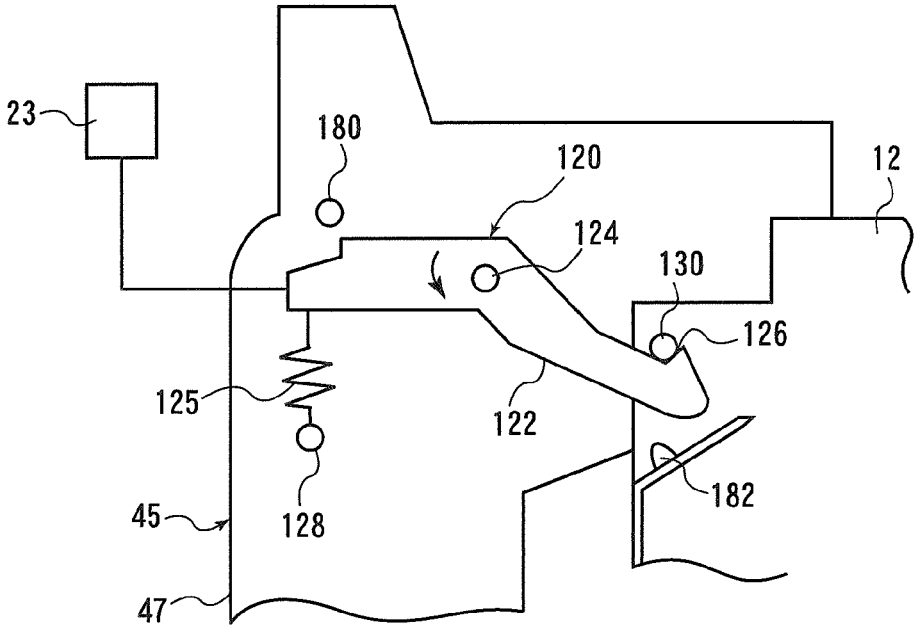
FIG. 9A is an explanatory view showing the fixing mechanism of the image forming apparatus according to the second exemplary embodiment of the present invention when the frame is fixed to the image forming apparatus main body.
Figure 9B:
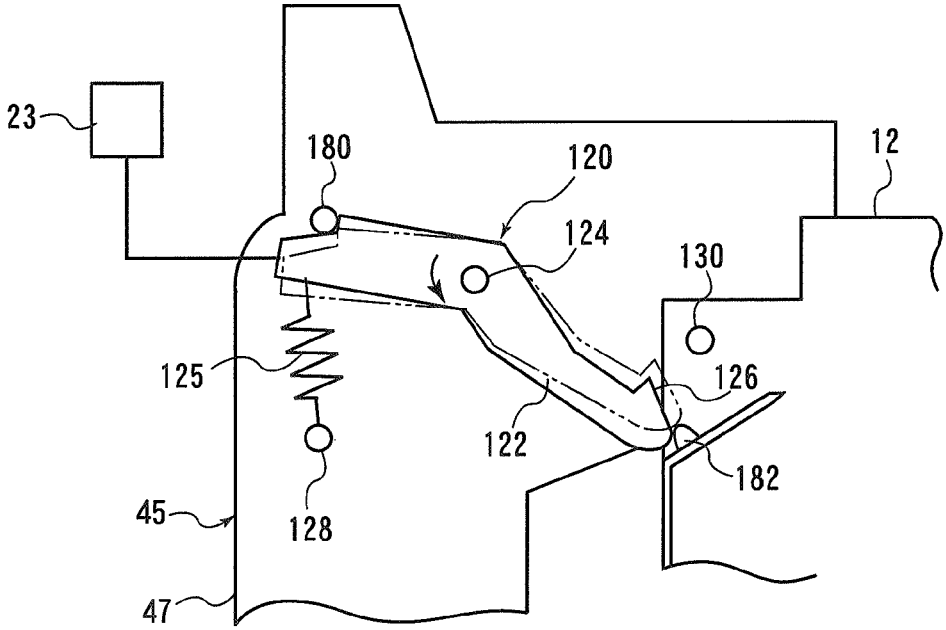
FIG. 9B is an explanatory view showing the fixing mechanism of the image forming apparatus according to the second exemplary embodiment of the present invention when the fixing of the frame to the image forming apparatus main body is released.

FIGS. 9A and 9B show the fixing mechanism 120 of the image forming apparatus 10 according to a second exemplary embodiment of the present invention. In the first exemplary embodiment, the arm member 122 is pressed with the spring 125 in the direction where the arm member is rotated counterclockwise. Accordingly, when the operator stops operation of the second operation button 23, the arm member 122 is returned from the position shown in FIG. 5B to the direction shown in FIG. 5A, but never remains in the position shown in FIG. 5B. On the other hand, in the second exemplary embodiment, a projection 180 to lock the arm member 122 in a release position is formed on the unit main body 47. When the arm member 122 is rotated clockwise, a part of the arm member 122 is engaged with the projection 180 and is locked in the release position. Accordingly, even when the operator stops operation of the second operation button 23, the arm member 122 stays in a position shown in FIG. 9B. Further, while the unit 45 and the open-close cover 17 are closed, the end of the engagement member 126 of the arm member 122 hits a projection 182 provided in the image forming apparatus main body 12, thereby the arm member 122 is rotated counterclockwise and disengaged from the projection 180. Thus the unit 45 is fixed to the image forming apparatus main body 12.

Figure 10A:
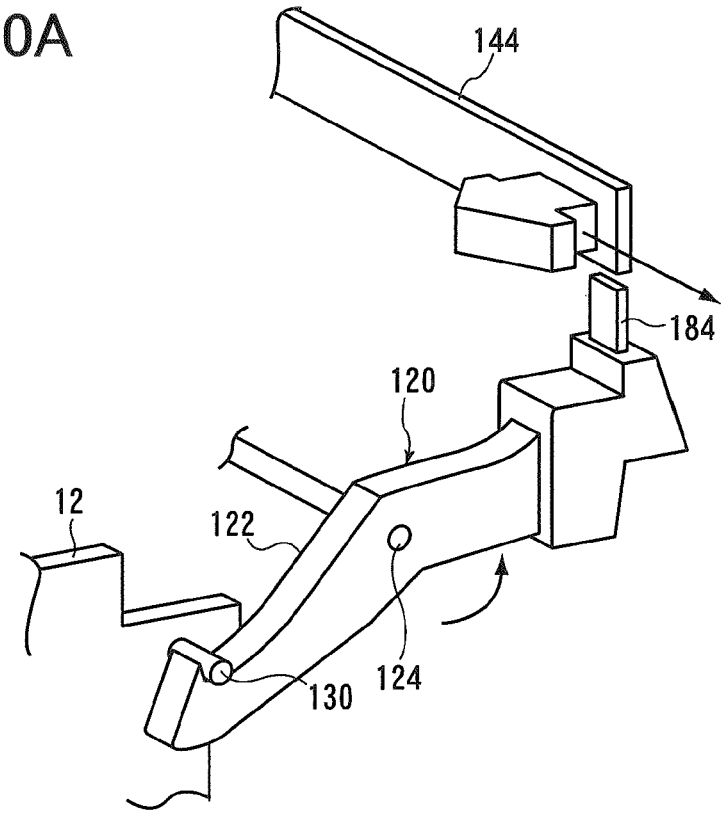
FIG. 10A is a perspective view showing the prohibition mechanism of the image forming apparatus according to the second exemplary embodiment of the present invention when release of connection between the unit and the open-close cover is prohibited.
Figure 10B:
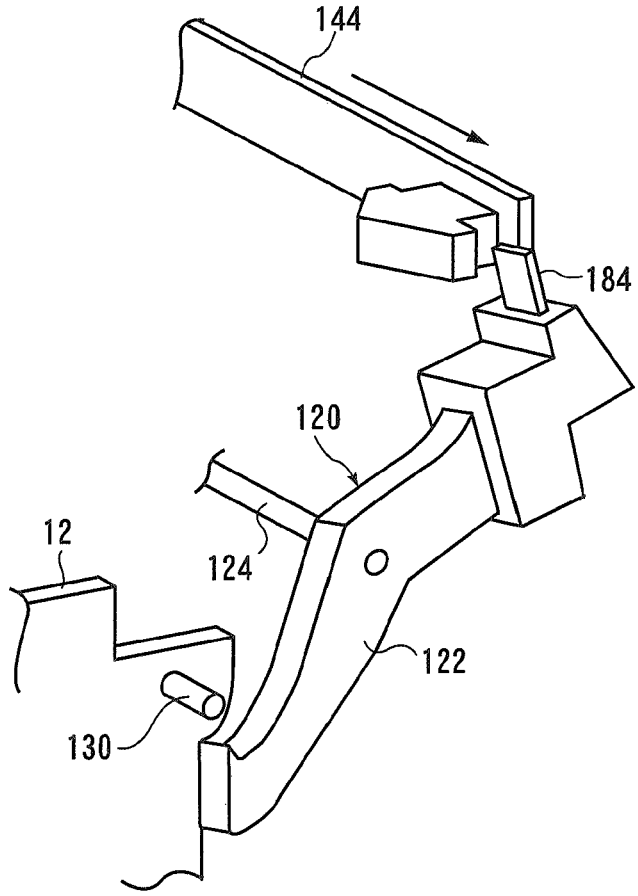
FIG. 10B is a perspective view showing the prohibition mechanism of the image forming apparatus according to the second exemplary embodiment of the present invention when release of connection between the unit and the open-close cover is permitted.

FIGS. 10A and 10B show the fixing mechanism 120 of the image forming apparatus 10 according to the second exemplary embodiment of the present invention. Note that the fixing mechanism 120 shown in FIGS. 10A and 10B is provided on the left side of the apparatus, i.e., provided oppositely to the fixing mechanism 120 shown in FIGS. 9A and 9B. An interference member 184 projected upward is provided on the arm member 122 on the opposite side to the engagement member 126. The interference member 184 can be provided in a position to interfere with the locus of the moving member 144 when moved leftward. The interference member 184 acts similarly to the pendulum member 160 in the first exemplary embodiment.

The interference member 184 does not interfere with the locus of the movement of the moving member 144 to the left side, but is moved between a position to permit the movement of the moving member 144 (hereinbelow, permission position) and a position to interfere with the movement of the moving member 144 in the leftward direction (hereinbelow, interference position). That is, as shown in FIG. 10A, when the arm member 122 is in a position to fix the unit 45 to the image forming apparatus main body 12, the interference member 184 is provided in the permission position. On the other hand, as shown in FIG. 10B, when the arm member 122 is provided in a position to release the connection between the unit 45 and the image forming apparatus main body 12, the interference member 184 is provided in the interference position.

In the fixing mechanism 120 according to the second exemplary embodiment having the above arrangement, in a status where the unit 45 is fixed to the image forming apparatus main body 12, when the operator depresses the first operation button 21, the moving member 144 is moved to the left side without interference by the interference member 184, and the connection between the open-close cover 17 and the unit 45 is released. Accordingly, only the open-close cover 17 can be opened with the unit 45 closed. On the other hand, when the operator manipulates the second operation button 23 and the fixing of the unit 45 with the fixing mechanism 120 to the image forming apparatus main body 12 is released, the interference member 184 is moved to the interference position. Even when the operator depresses the first operation button 21, the moving member 144 is not moved to the left side, and the connection between the open-close cover 17 and the unit 45 is not released. Accordingly, when the open-close cover 17 and the unit 45 integrated with each other are opened/closed, the connection between the open-close cover 17 and the unit 45 is not released, and there is no probability that the unit 45 is rapidly moved in a closing direction by the pressing from the pressing mechanism 96.

As described above, the present invention is applicable to image forming apparatuses such as a copier, a facsimile machine and a printer having a unit provided openably/closably with respect to an image forming apparatus main body, and an open-close cover provided openably/closably with respect to the image forming apparatus main body.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming apparatus main body that includes an image forming unit and a sheet conveyance unit;

a unit that is at least a part of the image forming unit or the sheet conveyance unit and is openably/closably provided with respect to the image forming apparatus main body;

an open-close cover that is openably/closably provided with respect to the image forming apparatus main body;

a connection unit that connects the unit to the open-close cover;

a connection release unit that releases connection between the unit and the open-close cover by the connection unit;

a pressing unit that presses the unit in a closing direction with respect to the image forming apparatus main body; and a prohibition unit that prohibits release of connection by the connection release unit.

2. The image forming apparatus according to claim 1, wherein, when the unit is released by a predetermined or larger amount, the prohibition unit prohibits the release of connection by the connection release unit.

3. The image forming apparatus according to claim 1, wherein, when the release of the unit is less than a predetermined amount, the prohibition unit permits the release of connection by the connection release unit.

4. The image forming apparatus according to claim 1, wherein, when the release of the unit is less than a predetermined amount, the prohibition unit permits the release of connection by the connection release unit, while when the unit is released by a predetermined or larger amount, the prohibition unit prohibits the release of connection by the connection release unit.

5. The image forming apparatus according to claim 1, wherein the unit comprises a fixing device that fixes a transferred developing material image to a sheet using a heating roller.

6. The image forming apparatus according to claim 1, wherein the prohibition unit comprises a pendulum member that rotates into an interference position as the unit is being opened, and thereby prohibits release of connection by the connection release unit.

7. An image forming apparatus comprising:

an image forming apparatus main body including an image forming unit and a sheet conveyance unit;

a unit that is at least a part of the image forming unit or the sheet conveyance unit and is openably/closably provided with respect to the image forming apparatus main body;

an open-close cover that is openably/closably provided with respect to the image forming apparatus main body;

a pressing mechanism with a biasing force that biases the unit in a closed direction with respect to the image forming apparatus main body;

a moving member that is provided movably to the unit or the open-close cover;

an engagement member provided in the moving member;

an engaged member that is engageable with the engagement member and is provided on the unit or the open-close cover;

a pressing member that presses the moving member in a direction to engage the engagement member with the engaged member;

a movement mechanism that moves the moving member in a direction to release engagement between the engagement member and the engaged member against pressing by the pressing member; and an interference member that can be provided in an interference position to interfere with a movement locus of the moving member in the direction to release engagement between the engagement member and the engaged member.

8. The image forming apparatus according to claim 7, wherein, when the unit is released by a predetermined or larger amount, the interference member is provided in the interference position.

9. The image forming apparatus according to claim 8, wherein, when the unit is released by a predetermined or larger amount, the interference member is provided in the interference position, while when the release of the unit is less than the predetermined amount, the interference member is provided in a permission position to permit the movement of the moving member in the direction to release the connection between the engagement member and the engaged member.

10. The image forming apparatus according to claim 8, further comprising a fixing mechanism that fixes at least one of the unit and the open-close cover to the image forming apparatus main body, wherein, when fixing is performed by the fixing mechanism, the interference member is provided in a permission position to permit the movement of the moving member in the direction to release engagement between the engagement member and the engaged member, while when the fixing by the fixing mechanism is released, the interference member is provided in the interference position.

11. The image forming apparatus according to claim 7, wherein, when the release of the unit is less than a predetermined amount, the interference member is provided in a permission position to permit the movement of the moving member in the direction to release the connection between the engagement member and the engaged member.

12. The image forming apparatus according to claim 7, wherein the interference member has:

a support member that is rotatably supported with the open-close cover or the unit; and a gravity center member that is integrated with the support member, and that has a center of gravity.

13. The image forming apparatus according to claim 7, further comprising a fixing mechanism that fixes at least one of the unit and the open-close cover to the image forming apparatus main body, wherein, when fixing is performed by the fixing mechanism, the interference member is provided in a permission position to permit the movement of the moving member in the direction to release engagement between the engagement member and the engaged member.

14. The image forming apparatus according to claim 7, further comprising a fixing mechanism that fixes at least one of the unit and the open-close cover to the image forming apparatus main body, wherein, when fixing by the fixing mechanism is released, the interference member is provided in the interference position.

15. The image forming apparatus according to claim 7, wherein the pressing mechanism biasing force is greater when the unit is open with respect to the image forming apparatus main body.

16. An image forming apparatus comprising:

an image forming apparatus main body that includes an exposure device and a developing device;

a cover that is rotatable into an open or closed position with respect to the image forming apparatus main body;

a unit that is rotatable into an open or closed position with respect to the image forming apparatus main body;

a pressing mechanism that biases the unit into a closed position with respect to the image forming apparatus main body; and a connection mechanism that prohibits separation of the unit and the cover when the unit and the cover are opened a predetermined distance with respect to the image forming apparatus, wherein the connection mechanism acts independently of a user;

wherein the cover moves into an open or closed position integrally with the unit when the connection mechanism prohibits separation, and independently of the unit when the connection mechanism does not prohibit separation.

* * * * *